US010092936B2

(12) United States Patent
Del Tedesco et al.

(10) Patent No.: US 10,092,936 B2
(45) Date of Patent: Oct. 9, 2018

(54) ACTIVE VIBRATION DAMPING SYSTEM OF A ROLLING MILL

(71) Applicant: Danieli & C. Officine Meccaniche S.P.A., Buttrio (IT)

(72) Inventors: Stefano Del Tedesco, Fontanafredda (IT); Andrea De Luca, Remanzacco (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 15/104,947

(22) PCT Filed: Dec. 22, 2014

(86) PCT No.: PCT/IB2014/067214

§ 371 (c)(1),
(2) Date: Jun. 15, 2016

(87) PCT Pub. No.: WO2015/092775

PCT Pub. Date: Jun. 25, 2015

(65) Prior Publication Data

US 2016/0318083 A1 Nov. 3, 2016

(30) Foreign Application Priority Data

Dec. 20, 2013 (IT) ..... MI2013A2170

(51) Int. Cl.
*B21B 37/00* (2006.01)
*B21B 38/00* (2006.01)

(52) U.S. Cl.
CPC ..... *B21B 37/007* (2013.01); *B21B 38/008* (2013.01)

(58) Field of Classification Search
CPC ..... B21B 37/00; B21B 37/007; B21B 37/66; B21B 38/00; B21B 38/008
See application file for complete search history.

(56) References Cited

U.S. PATENT DOCUMENTS

2011/0302976 A1* 12/2011 Keintzel ..... B21B 37/00 72/13.3

FOREIGN PATENT DOCUMENTS

| | | |
|---|---|---|
| AT | 507087 | 2/2010 |
| JP | 2000161175 | 6/2000 |
| JP | 2007536486 | 12/2007 |
| WO | WO0023204 | 4/2000 |

* cited by examiner

*Primary Examiner* — Teresa M Ekiert
(74) *Attorney, Agent, or Firm* — Stetina Brunda Garred & Brucker

(57) ABSTRACT

The active vibration damping system of a rolling mill comprises a rolling stand and an adjustment system for the bending of the rolling rolls (1, 1') having hydraulic actuators (2\2", 2''', 2iv) acting on the chock (20) of the rolling rolls (1, 1') and hydraulic feeding circuits (7, 9, 11, 12) and injectors (8', 8", 8''', 8iv), preferably piezoelectric injectors, directly inserted into the chambers (6\6", 6''', 6iv) of the hydraulic actuators (2', 2", 2''', 2iv) with the advantage of exploiting the dampening effect resulting from the high-pressure oil injection.

7 Claims, 7 Drawing Sheets

ACTIVE VIBRATION DAMPING SYSTEM OF A ROLLING MILL

CROSS REFERENCE TO RELATED APPLICATIONS

The present application claims priority to PCT International Application No. PCT/IB2014/067214 filed on Dec. 22, 2014, which application claims priority to Italian Patent Application No. MI2013A002170 filed Dec. 20, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a damping vibration system of a rolling stand, particularly for the cold rolling of strips.

BACKGROUND ART

Rolling stands comprising, as shown in FIG. 1, at least one pair of working or rolling rolls or cylinders 1, 1' which are directly in contact with the strip during the rolling process, are used for the cold rolling of strips. One of the two working rolls vertically overlaps the other.

Such a configuration is limited in the forces applicable for the elastic deformation of the rolls themselves. In order to obviate this drawback, rolling stands comprising multiple rolls, including at least two rolling rolls 1, 1' and two resting rolls 10, 10' which oppose the elastic deformation of the rolling rolls 1, 1', are used, which rolling rolls are intended to be in direct contact with the material to be rolled, as shown in the scheme in FIG. 1*b*.

Other configurations of rolling stands are known from the prior art, where two rolls are working rolls, two rolls are intermediate rolls and two rolls are resting rolls. Configurations having multiple cylinders or rolls are also known, some being shown, as an example, in FIG. 1*c*, 1*d*, 1*e*.

Every rolling stand is provided with various hydraulic actuators, including:

- two hydraulic cylinders placed, for example, on the top of the stand or under the stand, and acting on the resting chocks for adjusting the distance between the rolling rolls, thereby controlling the thickness of the strip being rolled;
- four or more hydraulic bending cylinders for each chock of the working rolls, defining a so-called bending control system which, acting on the chocks of the working rolls, change their elastic deformation allowing for the control of the planarity of the strip being rolled.

The rolling force is applied on the necks of the resting rolls for controlling the thickness of the strip being rolled, while further forces are applied, by means of the bending control system, on the chocks of the working rolls in order to control the planarity of the strip being rolled.

The bending system is controlled through servo valves controlling the pressure within the chambers of the hydraulic bending cylinders in order to obtain the desired extent of elastic deformation for the working rolls.

The servo valves controlling the bending of the rolls have response times of the order of 50-200 ms with cut-off frequencies smaller than 50 Hz.

The rolling speed defines each single rolling mill capacity, since all the rolling mills basically try to roll for the maximum time possible at speeds which are next to the maximum speeds achievable by the drive train and allowed by the power installed in the plant.

During the rolling process, some forcing may be generated which, under certain conditions, may trigger resonances mainly in the vertical arrangement direction of the working rolls.

Such forcings may be generated by:

- the strip itself, due to its intrinsic thickness or hardness variations;
- friction variations within the rolling room, especially when reaching the limit speed resulting in the—even temporary—breakage of the lubricating film;
- flaws induced in the working rolls during grinding operations;
- inadequate conditions of the stand mechanics, such as wears, clearances between various components and damaged rolling bearings;
- concurrently rolling hard material along with a strong thickness reduction and high rolling speed.

Rolling stands, just like any mechanical element, have some peculiar resonance frequencies. If said forcings have frequencies which are close to or matching such peculiar resonance frequencies, some phenomena of vibration may be induced.

Such phenomena occur with a movement of the rolls, transversally to the rolling direction, i.e. occur vertically and may reach widths which cannot be controlled and are not adequate to the rolling process.

Such phenomena are known as chattering and may generate surface defects, such as light/dark strip markings or thickness variations resulting in the wasting of the rolled strip, the flaws depending on how the stand vibrates.

In order to avoid flaws or breakages of the strip being rolled, which may result in damages to the rolling stand, upon detection of a chattering phenomenon, the person in charge of controlling the rolling process usually reduces the rolling speed or applies damping procedures for such a phenomenon.

Two main types of chattering are known in the art as third- or fifth-octave vibrations.

The third-octave resonance occurs at frequencies from 100 to 200 Hertz, while those of the fifth-octave occur at frequencies from 500 to 700 Hertz.

Such phenomena are characterized by different vibration modes: a third-octave resonance induces a first vibration mode in which a working roll and the related resting roll move accordingly, while the upper and lower rolls vibrate in counter phase; a fifth-octave resonance induces a second vibration mode, in which the working rolls vibrate while the resting rolls are motionless.

When these resonance phenomena occur during the rolling process, the rolling speed may be decreased from 20 to 50% of the rolling mill design speed.

Chattering is therefore a significant problem affecting the operativeness of rolling mills because, besides causing the wasting of the product, significantly reduces its production capacity.

Considering the importance of this issue, the chattering phenomenon in the rolling process has been the subject of deep study and experimentation activities.

By the application of vibration sensors or velocimeters suitably mounted to the rolling stands, the triggering of a resonance phenomenon may be determined and signalized in order to anticipate the rolling mill deceleration as much as possible.

Such systems are currently used in a fully automatic manner and allow for a constant and continuous verification of the rolling mill vibration level, also promoting preventive maintenance schedules thereof.

Such systems allow to minimize the qualitative drop, but do not solve the problem related to the reduction in the rolling plant production capacity.

The manufacture of active or passive vibration damping systems has been the subject of study, in order to allow for rolling processes at speeds closer and closer to the rolling mill design speeds.

AT507087A4 discloses an apparatus and method for the semi-active reduction of pressure oscillations in a hydraulic system of a cold or hot rolling mill. In such document, "Semi-active reduction of pressure oscillations" means a reduction of the pressure oscillation width in a hydraulic system by means of a passive pressure oscillation damper, where the natural frequency of the passive damper may be changed by means of an actuator. The technical teaching of this document is to avoid using active vibration damping systems since the energy additionally introduced into the hydraulic system, through the actuator, importantly worsens the whole system stability, and may result in a spoilage in the response of the system. Particularly, the AT507087A4 solution provides for the pressure vibration reduction in a hydraulic line using a Helmholtz resonator. The system allows to dissipate the vibrational energy of the fluid in a chamber connected to the hydraulic line, different from the chamber of the hydraulic cylinder, thus reducing the pressure oscillations within the hydraulic line. The damping system is passive and is controlled to calibrate the system according to the correct operating frequency, modifying the chamber volume. The actuator simply changes the resonator volume without injecting more fluid in the hydraulic system. This variation of the volume changes the natural frequency of the oscillation damper, thereby adapting the natural frequency of the oscillation damper to the pressure oscillation frequency.

A further example of passive damping system is suggested in WO00/23204, where a piezoelectric actuator acts on the hydraulic fluid of a roll regulation system. The piezoelectric actuator is embedded in one of the walls of a pressure vessel of the hydraulic system, such that the actuator can carry out only one displacement of the hydraulic fluid, thus causing a variation of the pressure within the vessel which leads to a regulation of the multiple cylinder rolling mill. Also in this case, the actuator does not inject further fluid into the hydraulic system.

SUMMARY OF THE INVENTION

It is an object of the present invention to provide an active damping system for the resonance vibrations of a cold rolling mill, which is simple and easily feasible, while maintaining high effectiveness.

It is a further object of the present invention to provide an active damping system for the resonance vibrations of a cold rolling mill, which is alternative and improving compared to the known art, which ensures a higher overall simplicity and small size.

The present invention relates to an active vibration damping system for a rolling stand, in particular for rolling strips, comprising two or more working rolls with respective chocks, the damping system comprising, according to claim 1, a plurality of hydraulic actuators having respective movable pistons, acting on said chocks, and respective chambers; a hydraulic circuit for feeding said plurality of hydraulic actuators; one or more injectors within said hydraulic circuit; characterized in that said one or more injectors are directly arranged within or in the proximity of the structure of the respective chambers of the hydraulic actuators to actuate an active damping of the vibrations of the working rolls, said injectors being adapted to inject pressurized oil into a respective chamber of the hydraulic actuators under the control of an electronic control unit.

The hydraulic circuit advantageously comprises:

- a low-pressure actuating line adapted to draw oil, or other suitable hydraulic fluid, from a first hydraulic station or utility to feed said hydraulic actuators,
- and a high-pressure branch or line, i.e. having an oil pressure higher than the operating pressure along the actuating line, adapted to draw oil, or other suitable hydraulic fluid, from a second hydraulic station or utility.

The injectors are adapted to put in communication the respective chambers of the hydraulic actuators with said high-pressure branch, substantially acting, in a preferred variant, as caps of the respective chambers.

According to the invention, the fluid injection is determined by the pressure difference between the high-pressure branch or line, about 1000 bars for example, and the operating pressure of the low-pressure actuating line, about 200 bars for example.

The actuating system of the injectors is intended to open an orifice according to a known control algorithm.

The injectors, which are preferably of the piezoelectric type for obtaining a more rapid and effective response in damping the vibrations occurring in a rolling stand for the cold rolling of strips, are advantageously directly arranged within the body or in direct proximity of the hydraulic actuators in order o improve the hydraulic system response even more.

Moreover, the damping system of the invention is exclusively an active damping system because energy is additionally introduced into the hydraulic system through the injectors. Therefore, the damping system of the invention acts in a dynamic manner, exerting some forcings to the hydraulic system, by injecting new fluid into the hydraulic system. The damping system conveniently applies a force by injecting new oil as a function of the roll displacement speed, for making the hydraulic system stable. In essence, the active damping system of the invention applies a force opposite to the force of the vibration, whereby a new disturbance is introduced into the hydraulic system which cancels the disturbance created by the vibration.

The dependent claims describe preferred embodiments of the present invention.

BRIEF DESCRIPTION OF THE DRAWINGS

Further features and advantages of the invention will become more apparent from the detailed description of preferred, but not exclusive, embodiments of an active damping system for the resonance vibrations of a rolling mill, particularly a cold rolling mill for strips, shown by way of a non-limiting example with the aid of the accompanying drawings, in which.

The same reference numerals and letters in the drawings identify the same elements or components.

DETAILED DESCRIPTION OF PREFERRED EMBODIMENTS OF THE INVENTION

Figure 1:
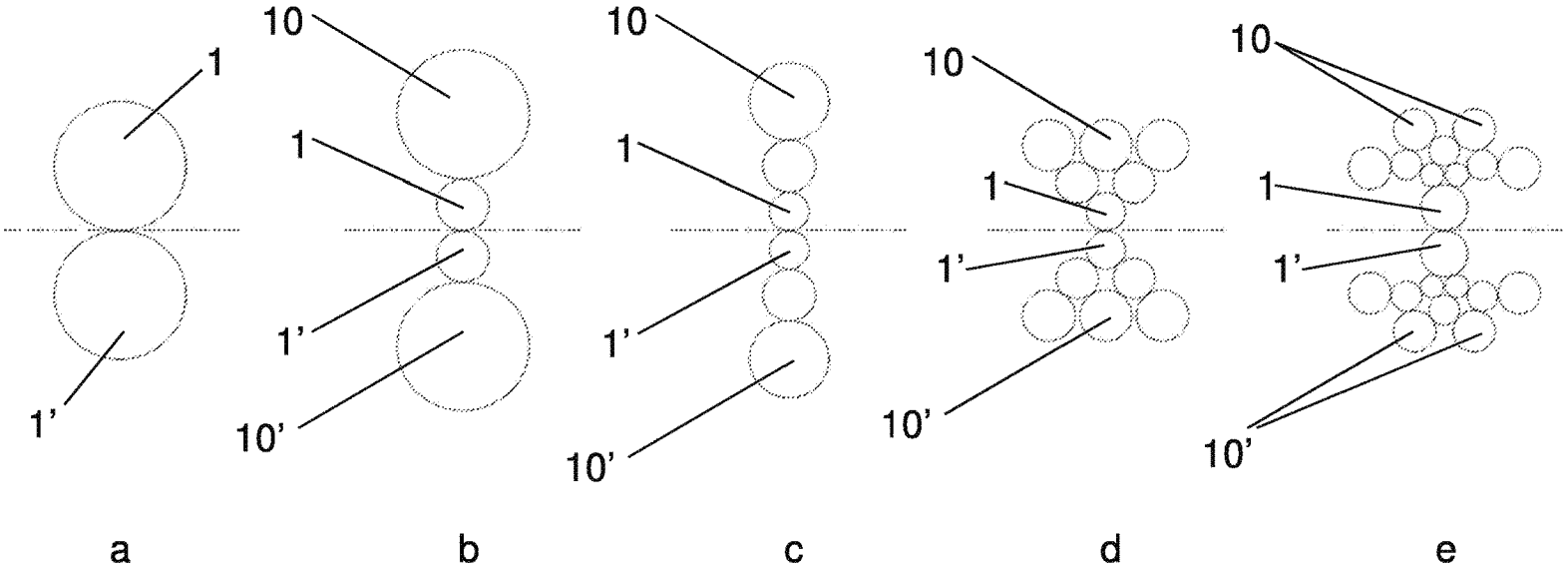
Fig. 1 Prior Art
FIGS. 1*a*-1*e* show some examples of rolling stand configurations of the prior art to which an active vibration damping system according to the present invention can be applied.
Figure 2:
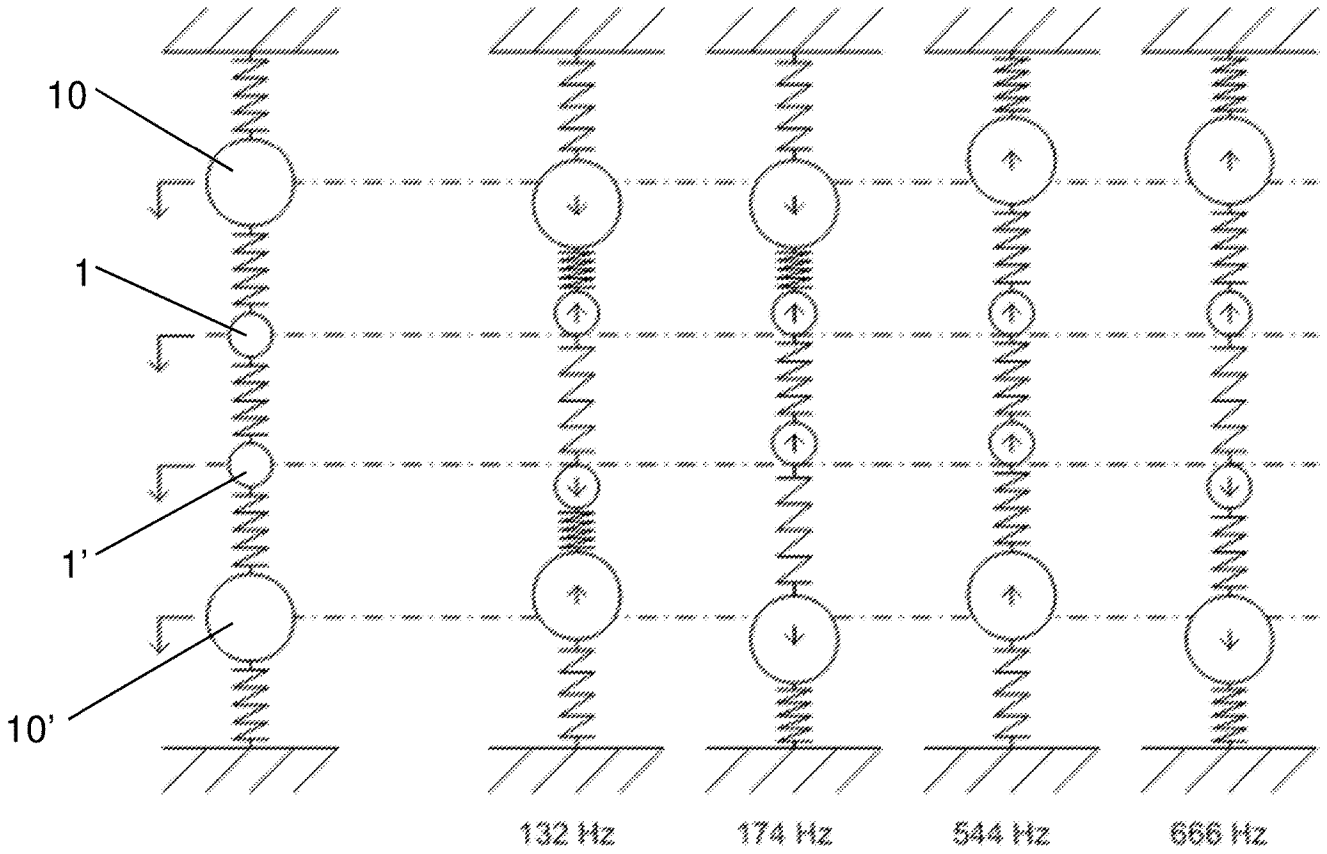
FIG. 2 shows vibration modes of a rolling stand without an, active damping system.

With reference to a stand of the type in FIG. 2, a simplified dynamic model of a rolling stand for strips is shown. Typical vibration modes of the stand at different frequency values are shown therein: particularly, in that example, the vibration modes are obtained for frequencies of 132, 174, 544, 666 Hz which depend on the dimensional and elastic features of the stand under examination. Therefore, as the bulk, elastic rigidity and damping parameters vary, the natural resonance frequencies change, being known that each rolling stand has its own resonance frequencies.

Due to the active damping of the present invention, irrespective of transient or stationary conditions generating the instability, the forcing Fv is cancelled due to the opposite damping Fs.

Figure 3:
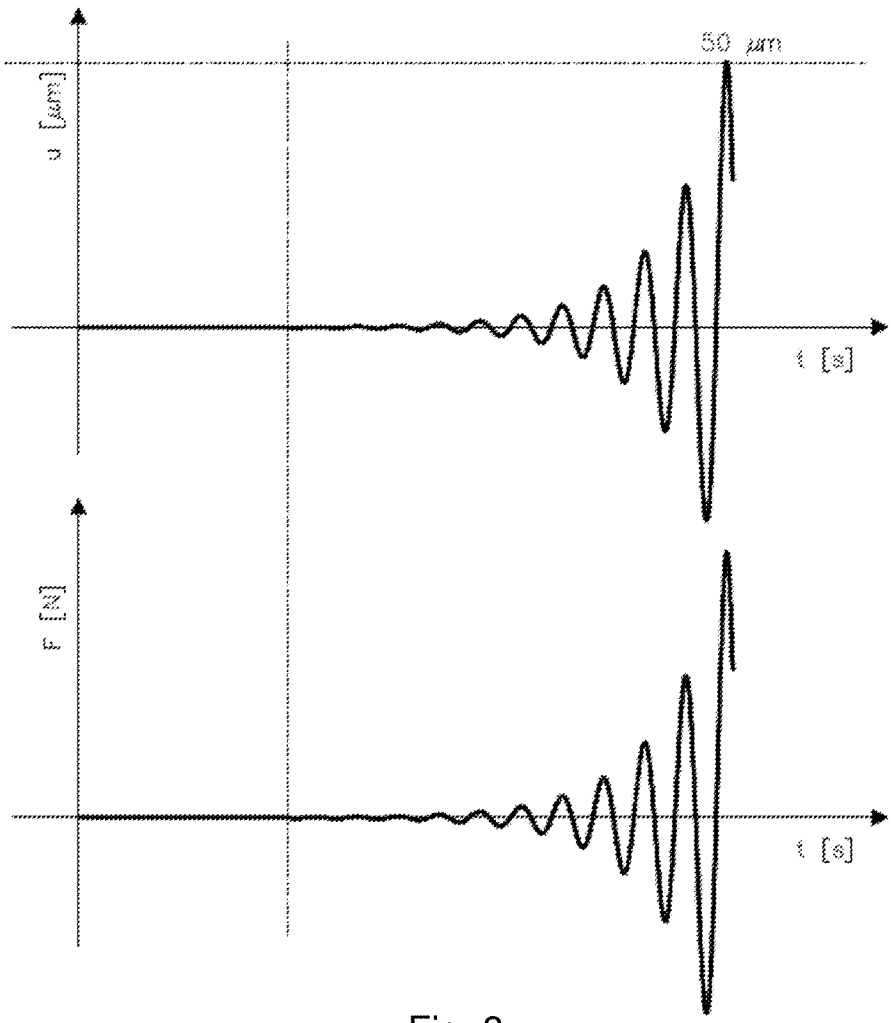
FIG. 3 shows two graphs depicting a thickness variation of a rolled strip over time and a pattern of a forcing in the same period of time determining said thickness variation, respectively; the vertical dashed line indicating a time instant when the phenomenon takes place and the horizontal dashed line indicating a breakage limit of the strip.
Figure 4:
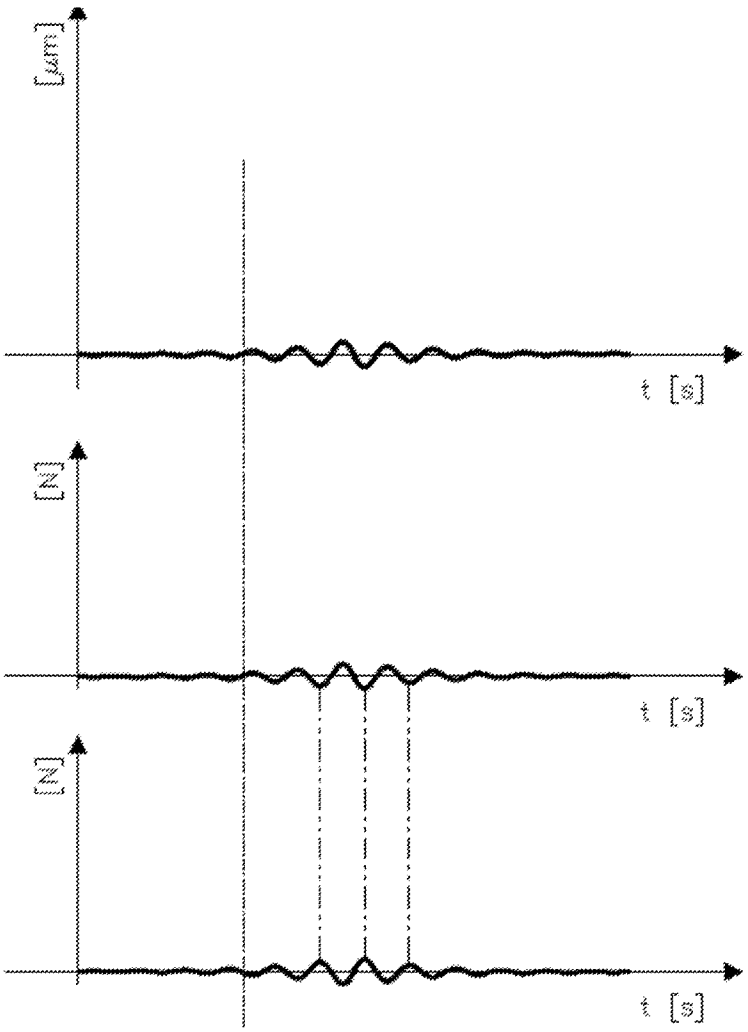
FIG. 4 schematically shows, according to the present invention, examples of three further graphs, depicting, from top to bottom, a thickness variation of a rolled strip over time, a pattern of a forcing in the same period of time determining said thickness variation, and a pattern of a damping action aimed at eliminating the effect of said forcing.

FIG. 3 shows an example of the third-octave resonant vibration when the active damping system of the invention is disabled or is not provided. Specifically, in the upper graph in FIG. 3, there is shown a strip thickness tolerance variation which, at the point where the chattering triggers—indicated by a vertical dashed line—starts to overstep its optimal conditions indicated by a band which is usually of +/−2 μm; therefore, the thickness becomes variable since the resonance takes place at a higher frequency than the passband of the control system of the planarity of the rolling mill. In the lower graph in FIG. 3, a pattern of the forcing which induces such tolerance variations is shown. Therefore, in similar instances, the thickness of the rolled strip undergoes variations which may reach and exceed +/−50 μm, with the risk of breaking the strip itself.

Furthermore, FIG. 2 schematically shows the vibration modes of a rolling stand comprising two working rolls 1, 1' and only two resting rolls 10, 10', when the active damping system of the invention is absent or disabled.

The invention includes the integration of an active vibration damping device, as described in detail below, within the device for controlling the bending of the working rolls 1 and 1', i.e. within the system for controlling the planarity (bending) of the working rolls.

Figure 5:
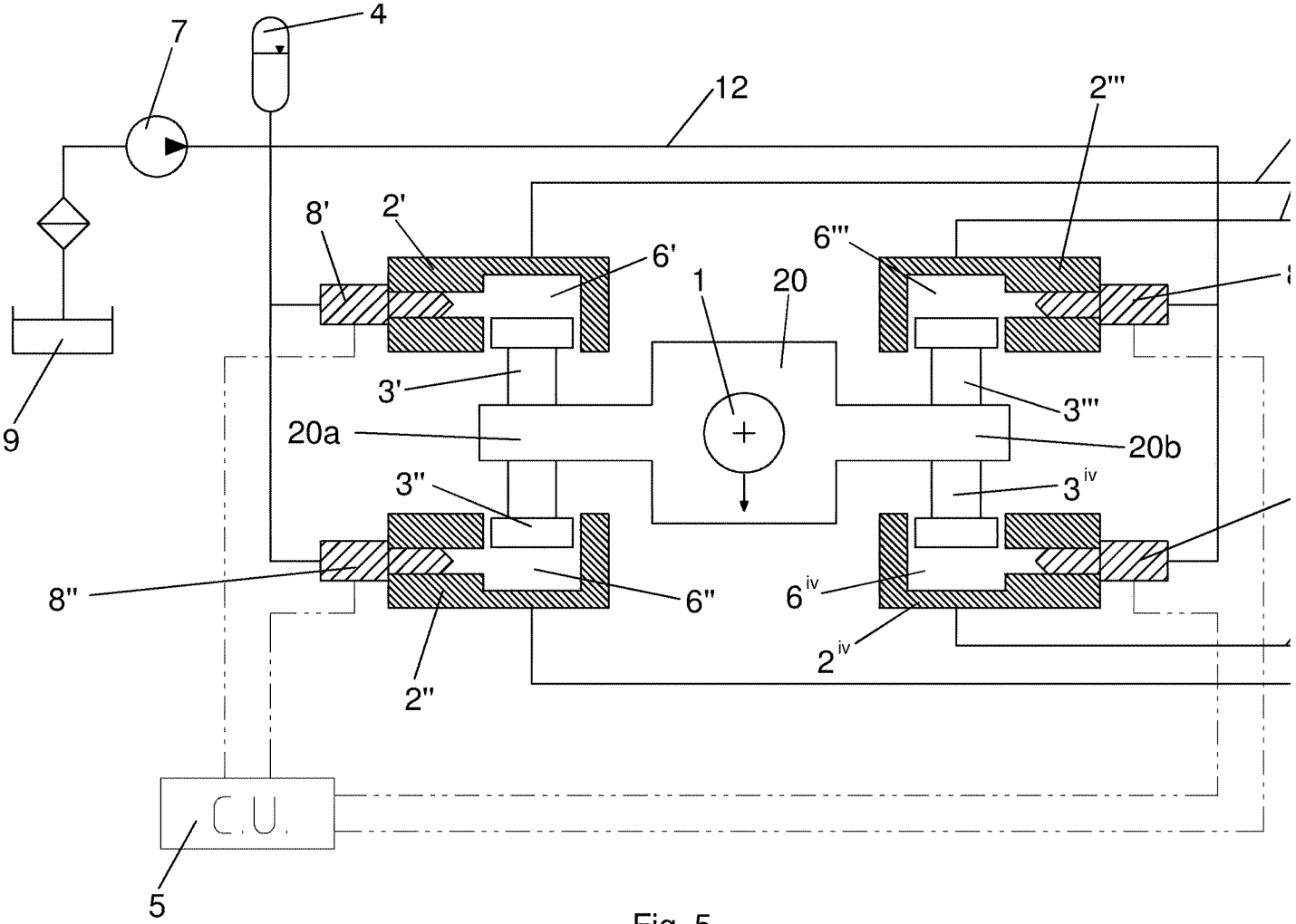
FIG. 5 shows a scheme for implementing the active damping system of the invention to the chocks of a rolling stand of a rolling mill.

Referring to the schematic configuration of the active damping system in FIG. 5, there is shown the chock 20 of an upper working roll 1 but, for ease of understanding, the chock of the lower working roll 1', which is equal to chock 20 except that it is symmetrically arranged, has not been shown. The ends 20*a*, 20*b* of chock 20 are respectively arranged between the pistons 3', 3", 3''', 3$^{iv}$ of the hydraulic actuators 2', 2", 2''' and 2$^{iv}$ , also simply referred to as bending cylinders.

Specifically, the motion of the hydraulic actuators 2', 2", 2''' and 2$^{iv}$ is coordinated so that a lifting of the upper roll 1 corresponds to a lowering of the lower roll 1', and vice versa. To do so, the pairs of actuators 2', 2" and 2''', 2$^{iv}$ work coordinately together in the same direction of mutual approach/spacing, while the pairs (not shown) of hydraulic actuators operating on the chock of the lower roll 1', work coordinately together in the same direction of mutual approach/spacing.

The bending cylinders 2', 2", 2''', 2$^{iv}$ are typically fed by an actuating line 11 drawing oil in a known manner from a suitable hydraulic utility or plant (not shown in FIG. 5).

Figure 8:
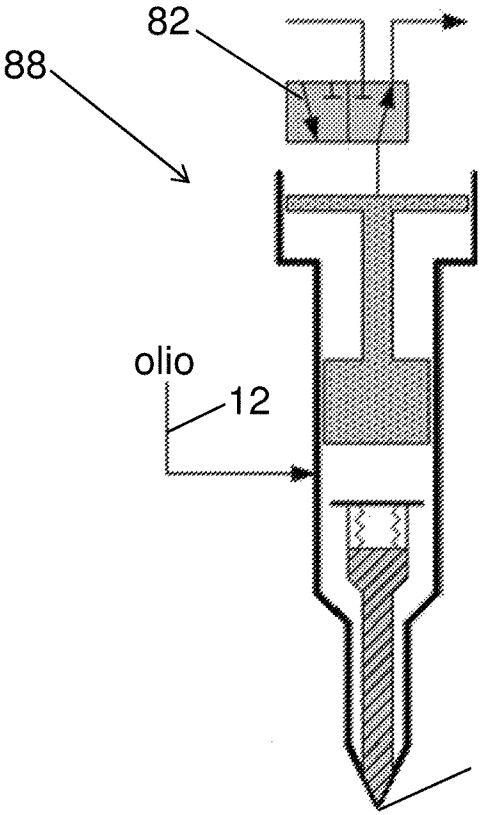
FIG. 8 shows a scheme of a component of the active damping system of the invention in a third alternative variant.
Figure 6:
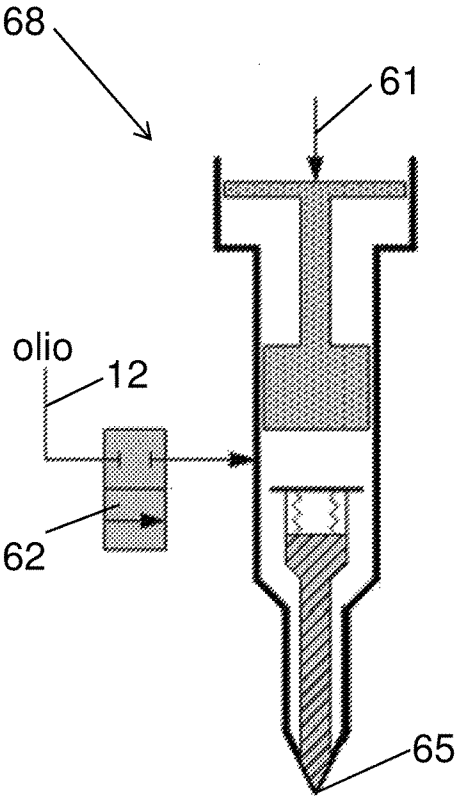
FIG. 6 shows a scheme of a component of the active damping system of the invention in a first variant.

For each bending cylinder 2', 2', 2''', 2$^{iv}$ , one or more respective injectors 8', 8", 8''', 8$^{iv}$ are further provided, which are controlled by means of mechanical means, as in FIG. 6, or by means of solenoid valves, as in FIG. 8. Preferably, the injectors are of the piezoelectric type, as shown in the scheme in FIG. 7, such a variant allowing for a much better reaction to the control. The injectors put the chambers 6', 6", 6''', 6$^{iv}$ of the bending cylinders 2', 2", 2''', 2$^{iv}$ in communication with a high-pressurized branch 12 of the hydraulic circuit provided in the rolling plant.

Injector 68, shown in the scheme in FIG. 6, which is mechanically controlled by means of a cam which acts with an actuating force directed in the direction of arrow 61, has a valve 62 of the solenoid type for controlling the pressurized oil, which is controlled synchronously with the action of the cam by injecting oil from orifice 65 into the chamber 6', 6", 6''', 6$^{iv}$ , according to a control algorithm which produces the active damping of the vibrations in order to eliminate the chattering phenomenon.

Injector 88, shown in the scheme in FIG. 8 and similar to that in FIG. 6, provides for the oil injection control by means of a hydraulic solenoid valve 82 and injects the oil into the chamber 6', 6", 6''', 6$^{iv}$ through orifice 85.

Figure 7:
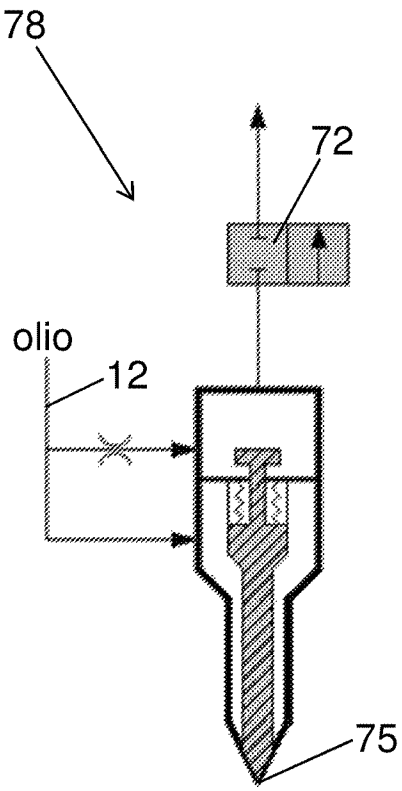
FIG. 7 shows a scheme of a component of the active damping system of the invention in a second alternative variant.

The injectors of the piezoelectric type, with particular reference to FIG. 7, where the scheme of one of them is shown with reference numeral 78, which may be used in the present solution, also are of the type used for feeding fuel into diesel engines, just like the previous injectors, with high control dynamics and a minimum interval of 200 μs between two subsequent injections; such injectors are commercially available. It is understood that all the injectors 8', 8", 8''', 8$^{iv}$ are perfectly equal to one other irrespective of their amount, Piezoelectric injectors 8', 8", 8''', 8$^{iv}$ are electrically powered and suitably controlled in a coordinated manner by an electronic control unit 5, or control unit CU which, based on the signals received by instruments for detecting the vibrations occurring within the stand, detects the vibration level and controls the piezoelectric valve 72 (FIG. 7) with a convenient active damping law. i.e. by means of a suitable control algorithm of known type, which controls the opening and closing of the valve required to produce the active damping.

The electronic control unit 5, when necessary, activates the piezoelectric valves 72 of the piezoelectric injectors 8', 8", 8''', 8$^{iv}$ through an electric control, so as to instantaneously introduce high-pressure oil into the chambers of the bending cylinders 2', 2", 2''', 2$^{iv}$ through orifice 75 from the high-pressurized branch 12, so as to dampen the undesired vibrations within the rolling stand according to the aforementioned damping law.

The injector control process which allows the active damping to be produced includes the following stages:

1) detecting the chattering phenomenon by means of the continuous control carried out with said detection instruments, such as vibrations sensors or velocimeters, 2) processing the acquired data in the electronic control unit 5, and 3) controlling the injectors 8', 8", 8''', 8$^{iv}$ to make them introduce oil into the bending chambers 6', 6", 6''', 6$^{iv}$ in order to dampen the vertical vibrations of the stand.

The oil operating pressure within the bending chambers 6', 6", 6''', 6$^{iv}$ of the bending cylinders 2', 2", 2''', 2$^{iv}$ and along the actuating line 11 of the bending cylinders reaches about 200 bars. The oil pressure within the high-pressurized line 12 is 700-1800 bars and corresponds to the pressure at which oil is introduced into the bending chambers 6', 6", 6''', 6$^{iv}$ of the bending cylinders 2', 2", 2''', 2$^{iv}$ when the piezoelectric injectors 8', 8", 8''', 8$^{iv}$ open their valve and allow for the oil to flow.

In a first variant, the preferably piezoelectric injectors 8', 8", 8''', 8$^{iv}$ are advantageously placed directly within the structure of the respective bending chambers 6', 6", 6''', 6$^{iv}$ of the bending cylinders 2', 2", 2''', 2$^{iv}$ , with the injection orifice being in direct communication with the respective bending chamber so as to have an immediate and optimal effect, and avoid the spoilage necessarily resulting if the damping effect is applied along the feeding line, at a greater distance from the respective bending chamber.

Depending on the pressures involved in the active damping system of the invention, two or more piezoelectric injectors 8', 8", 8''', 8$^{iv}$ for each of the bending cylinders 2', 2", 2''', 2$^{iv}$ can also be provided, so as to achieve an even wider range of effects and oppose any type of vibrations which are likely to occur within the rolling plant.

Figure 5A:
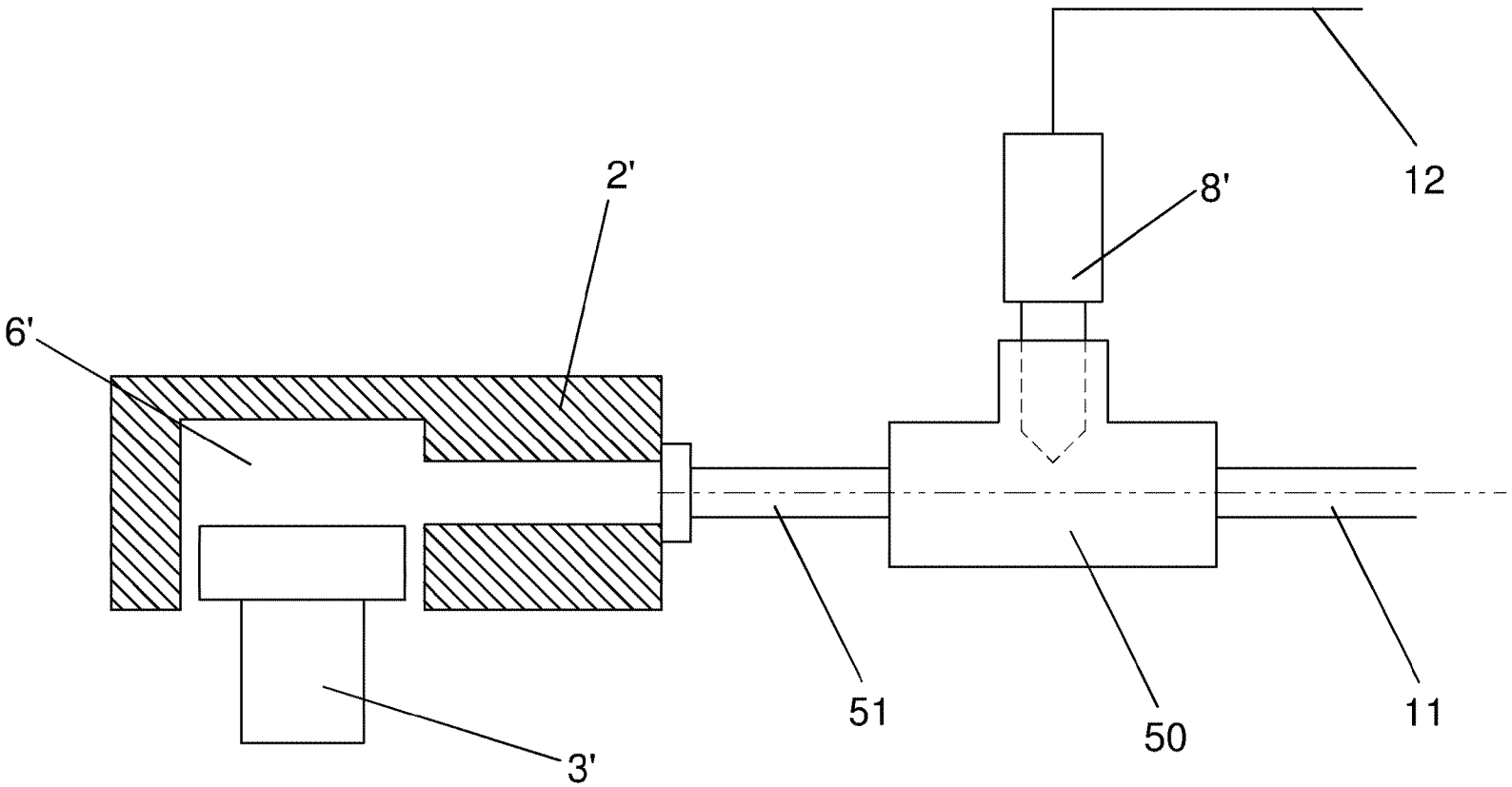
FIG. 5*a* shows a variant of part of the scheme in FIG. 5.

A second variant, shown in FIG. 5*a*, provides injectors 8', 8", 8''', 8$^{iv}$ advantageously placed in direct proximity to the structure of the respective bending chambers 6', 6", 6''', 6$^{iv}$ of the bending cylinders 2', 2", 2''', 2$^{iv}$ . For simplicity, only one injector and only one bending chamber 6' are shown in FIG. 5*a*.

Preferably, the injection orifice of the single injector is in direct communication with a first side of a connecting sleeve 50, for example T-shaped, placed in the proximity of the respective bending chamber and connected thereto by means of a conduit extension 51, so as to still have an immediate and optimal effect and avoid the spoilage necessarily resulting if the damping effect is applied along the feeding or actuating line 11, at a greater distance from the respective bending chamber. The distance between the connecting sleeve 50 and the structure of the respective bending chamber 6' preferably ranges from 0.5 to 10 m, preferably from 0,5 to 1 m, from 1 to 5 m, from 5 to 10. The conduit extension 51 covers the distance between the connecting sleeve 50 and the structure of the respective bending chamber 6', connecting a second side of the connecting sleeve 50 to the bending chamber 6'. The actuating line 11 is connected to said conduit extension 51 by means of a third side of the connecting sleeve 50.

The oil of the active damping line is advantageously, but not necessarily, drawn from the hydraulic station 9 (FIG. 5) of the rolling stand, filtered and inserted into a line or branch or common rail of high pressure distribution 12, which with its volume compensates for the instantaneous pressure difference due to the injectors. Pump 7 can be controlled in torque (brushless) to maintain the pressure in the line constant. Optionally, a small accumulator 4 (FIG. 5) can be also used.

Due to the configuration of the above-described active damping system of the invention, various advantages are achieved:

- using injectors already widely commercially available for other applications, the manufacture of the active damping system results in a considerable advantage in terms of costs;
- in the preferred variant which includes the arrangement of injectors in the bending cylinder chamber, or in the proximity thereof, the whole damping effect resulting from the high pressure oil injection is exploited;
- the active damping system is small in size;
- the plant simplicity obtainable in the rolling plant design is not of secondary importance, since making a new complex hydraulic plant in addition to the existing one is not required.

The elements and features shown in the different preferred embodiments can be combined without departing from the scope of protection of the present invention.

The invention claimed is:

1. An active vibration damping system for a rolling stand, comprising two or more working rolls with respective chocks, the damping system comprising:

a plurality of hydraulic actuators having respective movable pistons, acting on said chocks, and respective bending chambers, a hydraulic circuit for feeding said plurality of hydraulic actuators, one or more injectors within said hydraulic circuit, wherein said one or more injectors are directly arranged within or in proximity of a structure of the respective bending chambers of the hydraulic actuators to actuate an active damping of vibrations of the working rolls, said injectors being adapted to inject pressurized oil into a respective bending chamber of the hydraulic actuators under control of an electronic control unit.

2. An active vibration damping system according to claim 1, wherein said hydraulic circuit comprises an actuating line, adapted to draw oil from a first hydraulic station to feed said hydraulic actuators, and a high-pressurized branch, having an oil pressure greater than an operating pressure along the actuating line, adapted to draw oil from a second hydraulic station, and wherein said injectors are adapted to put in communication the respective bending chambers of the hydraulic actuators with said high-pressurized branch.

3. An active vibration damping system according to claim 1, wherein the one or more injectors are of piezoelectric type.

4. An active vibration damping system according to claim 1, wherein an injection orifice of the injectors is in direct communication with a respective bending chamber.

5. An active vibration damping system according to claim 1, wherein an injection orifice of the injectors is in direct communication with a first side of a connecting sleeve, placed in proximity of a respective bending chamber and connected thereto by means of a conduit extension.

6. An active vibration damping system according to claim 5, wherein the conduit extension connects a second side of the connecting sleeve to the bending chamber, while the actuating line is connected to said conduit extension by means of a third side of the connecting sleeve.

7. A rolling mill comprising at least one rolling stand provided with two or more working rolls with respective chocks, and an active vibration damping system comprising a plurality of hydraulic actuators having respective movable pistons, acting on said chocks, and respective bending chambers, a hydraulic circuit for feeding said plurality of hydraulic actuators, one or more injectors within said hydraulic circuit, wherein said one or more injectors are directly arranged within or in proximity of a structure of the respective bending chambers of the hydraulic actuators to actuate an active damping of vibrations of the working rolls, said injectors being adapted to inject pressurized oil into a respective bending chamber of the hydraulic actuators under control of an electronic control unit.

* * * * *